US009464466B2

(12) United States Patent
Nozawa et al.

(10) Patent No.: US 9,464,466 B2
(45) Date of Patent: Oct. 11, 2016

(54) DOOR LATCH DEVICE FOR VEHICLE AND METHOD OF ASSEMBLING DOOR LATCH DEVICE FOR VEHICLE

(71) Applicant: MITSUI KINZOKU ACT CORPORATION, Kanagawa (JP)

(72) Inventors: Hideaki Nozawa, Kanagawa (JP); Tomoharu Nagaoka, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 0 days.

(21) Appl. No.: 14/805,215

(22) Filed: Jul. 21, 2015

(65) Prior Publication Data

US 2016/0123046 A1 May 5, 2016

(30) Foreign Application Priority Data

Oct. 29, 2014 (JP) ..... 2014-220836

(51) Int. Cl.

| | |
|---|---|
| ***E05C 3/06*** | (2006.01) |
| ***E05B 85/24*** | (2014.01) |
| ***E05B 79/08*** | (2014.01) |
| *E05B 81/06* | (2014.01) |
| *E05B 81/16* | (2014.01) |

(52) U.S. Cl.

CPC ..... *E05B 85/243* (2013.01); *E05B 79/08* (2013.01); *E05B 81/06* (2013.01); *E05B 81/16* (2013.01); *E05B 85/24* (2013.01)

(58) Field of Classification Search

CPC ..... E05B 79/10; E05B 79/22; E05B 85/02; E05B 85/20; E05B 85/24; E05B 85/243; E05B 85/26; E05B 77/02; E05B 77/04; E05B 77/06; E05B 81/06; E05B 81/16; E05B 79/08

See application file for complete search history.

(56) References Cited

U.S. PATENT DOCUMENTS

| | | | | |
|---|---|---|---|---|
| 4,756,563 | A * | 7/1988 | Garwood | E05B 85/243 292/216 |
| 5,516,164 | A * | 5/1996 | Kobayashi | E05B 81/20 292/201 |
| 7,478,846 | B2 * | 1/2009 | Yoshikuwa | E05B 83/36 292/201 |
| 9,180,798 | B2 * | 11/2015 | Suzumura | B60N 2/366 |
| 2009/0199605 | A1 * | 8/2009 | Spurr | E05B 81/14 70/266 |
| 2011/0204675 | A1 * | 8/2011 | Sonnek | E05F 15/70 296/146.4 |

(Continued)

FOREIGN PATENT DOCUMENTS

| | | | |
|---|---|---|---|
| JP | 2007197974 | A * | 8/2007 |
| JP | 2008063913 | A * | 3/2008 |

(Continued)

*Primary Examiner* — Hanh V Tran
(74) *Attorney, Agent, or Firm* — McDermott Will & Emery LLP

(57) ABSTRACT

A door latch device for a vehicle includes: a body having a striker advancing groove formed on one surface thereof through which a striker arranged on a vehicle body advances corresponding to a closing movement of the door; a latch configured to engage with the advanced striker to be rotatable; a pole configured to rotate interlocking with the rotation of the latch and engaged with the latch so as to restrain the door at a closed position; a lever configured to rotate based on an opening operation of a handle arranged on the door to rotate the interlocking pole; and a spring configured to urge the lever. The lever has a shaft hole. The body includes a spring accommodating part that accommodates the spring, and a pivot that is inserted to the shaft hole of the lever to rotatably support the lever.

7 Claims, 13 Drawing Sheets

(56) References Cited

U.S. PATENT DOCUMENTS

| | | | | |
|---|---|---|---|---|
| 2012/0110920 | A1* | 5/2012 | Takagi | E05B 77/06 49/503 |
| 2012/0181798 | A1* | 7/2012 | Margheritti | E05B 77/32 292/200 |
| 2012/0256429 | A1* | 10/2012 | Nagaoka | E05B 77/34 292/200 |
| 2012/0292927 | A1* | 11/2012 | Vazquez | B23P 11/00 292/200 |
| 2012/0299313 | A1* | 11/2012 | Organek | E05B 17/007 292/129 |
| 2013/0056996 | A1* | 3/2013 | Akizuki | E05B 81/06 292/196 |
| 2013/0285389 | A1* | 10/2013 | Akizuki | E05B 83/36 292/100 |
| 2014/0217753 | A1* | 8/2014 | Bendel | E05B 15/04 292/223 |
| 2014/0284944 | A1* | 9/2014 | Rosales | E05B 85/26 292/113 |
| 2015/0204121 | A1* | 7/2015 | Bendel | E05B 15/04 292/220 |

FOREIGN PATENT DOCUMENTS

| | | | | |
|---|---|---|---|---|
| JP | 2009167729 | A | * | 7/2009 |
| JP | 2009235753 | A | * | 10/2009 |
| JP | 2009235756 | A | * | 10/2009 |
| JP | 2010189957 | A | * | 9/2010 |
| JP | 2011140803 | A | * | 7/2011 |
| JP | 2011153431 | A | * | 8/2011 |
| JP | 4765123 | B2 | | 9/2011 |
| JP | 2012-233318 | A | | 11/2012 |
| JP | 2012211502 | A | * | 11/2012 |

* cited by examiner

DOOR LATCH DEVICE FOR VEHICLE AND METHOD OF ASSEMBLING DOOR LATCH DEVICE FOR VEHICLE

CROSS-REFERENCE TO RELATED APPLICATION(S)

The present application claims priority to and incorporates by reference the entire contents of Japanese Patent Application No. 2014-220836 filed in Japan on Oct. 29, 2014.

BACKGROUND OF THE INVENTION

1. Field of the Invention

The present invention relates to a door latch device for a vehicle and a method of assembling the door latch device for a vehicle.

2. Description of the Related Art

Some door latch devices for a vehicle are configured by integrating an engaging unit assembly including a body made of synthetic resin that is fixed to a door, a latch that is stored in the body and is capable of engaging with a striker on a vehicle body side, and an engaging mechanism such as a pole that is capable of engaging with the latch, and an operation unit assembly including a casing made of synthetic resin that is fixed to a rear side of the body and an operation mechanism that is mounted into the casing and can switch a locked state and an unlocked state of the door by operating the engaging mechanism (for example, refer to Japanese Patent No. 4765123 and Japanese Patent Application Laid-open No. 2012-233318). Such door latch devices for a vehicle include a lever that rotates the pole to disengage the latch from the pole based on an opening operation of a handle arranged on the door.

In recent years, automatic assembly has been performed to improve assembling efficiency of the door latch devices, and further improvement in assembling efficiency has been required. In the related art, an outside lever that disengages the latch from the pole based on the opening operation of an outside handle arranged on a vehicle exterior side of a door is rotatably fixed to the casing of the operation unit assembly with a screw. Accordingly, a screwing process is required to mount the outside lever, and the assembling efficiency may be disadvantageously lowered.

SUMMARY OF THE INVENTION

It is an object of the present invention to at least partially solve the problems in the conventional technology.

A door latch device for a vehicle according to one aspect of the present invention includes: a body that is arranged on any one of a door or a vehicle body and has a striker advancing groove formed on one surface thereof through which a striker advances corresponding to a closing movement of the door, the striker being arranged on the other one of the door and the vehicle body; a latch configured to engage with the advanced striker so as to be rotatable from an open position to a latch position; a pole configured to rotate from a release position at which the Dole is disengaged from the latch to an engaging position at which the pole is capable of engaging with the latch at the latch position interlocking with rotation of the latch and be engaged with the latch so as to restrain the door at a closed position; a lever configured to rotate from a disengaging position to a standby position based on an opening operation of a handle to rotate the interlocking pole from the release position to the engaging position, the handle being arranged on the door or the vehicle body; and a spring configured to urge the lever to rotate from the disengaging position to the standby position. The lever has a shaft hole. The body comprises: a spring accommodating part that accommodates the spring; and a pivot that is inserted into the shaft hole of the lever to rotatably support the lever.

According to another aspect of the invention, a method of assembling a door latch device for a vehicle is provided. The door latch device for a vehicle includes: a body that is arranged on any one of a door or a vehicle body and has a striker advancing groove formed on one surface thereof through which a striker advances corresponding to a closing movement of the door, the striker being arranged on the other one of the door and the vehicle body; a latch configured to engage with the advanced striker to be rotatable from an open position to a latch position; a pole configured to rotate from a release position at which the pole is disengaged from the latch to an engaging position at which the pole is capable of engaging with the latch at the latch position interlocking with rotation of the latch and be engaged with the latch so as to restrain the door at a closed position; a lever configured to rotate from a disengaging position to a standby position based on an opening operation of a handle to rotate the interlocking pole from the release position to the engaging position, the handle being arranged on the door or the vehicle body; and a spring configured to urge the lever to rotate from the disengaging position to the standby position. The lever has a shaft hole. The body includes: a spring accommodating part that accommodates the spring; a pivot that is inserted into the shaft hole of the lever to rotatably support the lever; a hooked part to which one end of the spring is hooked; and a projection that is brought into contact with the lever at the standby position. The method includes: a mounting process of the spring for causing one end of the spring to be hooked to the hooked part, and causing the other end of the spring to be brought into contact with the projection of the body; a temporary mounting process of the lever for inserting the pivot of the body into the shaft hole of the lever, and causing a surface of the lever on the body side to be brought into contact with the projection of the body; and a mounting process of the lever for pressing the lever toward the body side to rotate in a direction against an urging force from the spring, and tightly inserting the lever between the other end of the spring and the projection of the body.

A door latch device for a vehicle according to still another aspect of the invention is manufactured by using the method of assembling the door latch device for a vehicle above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
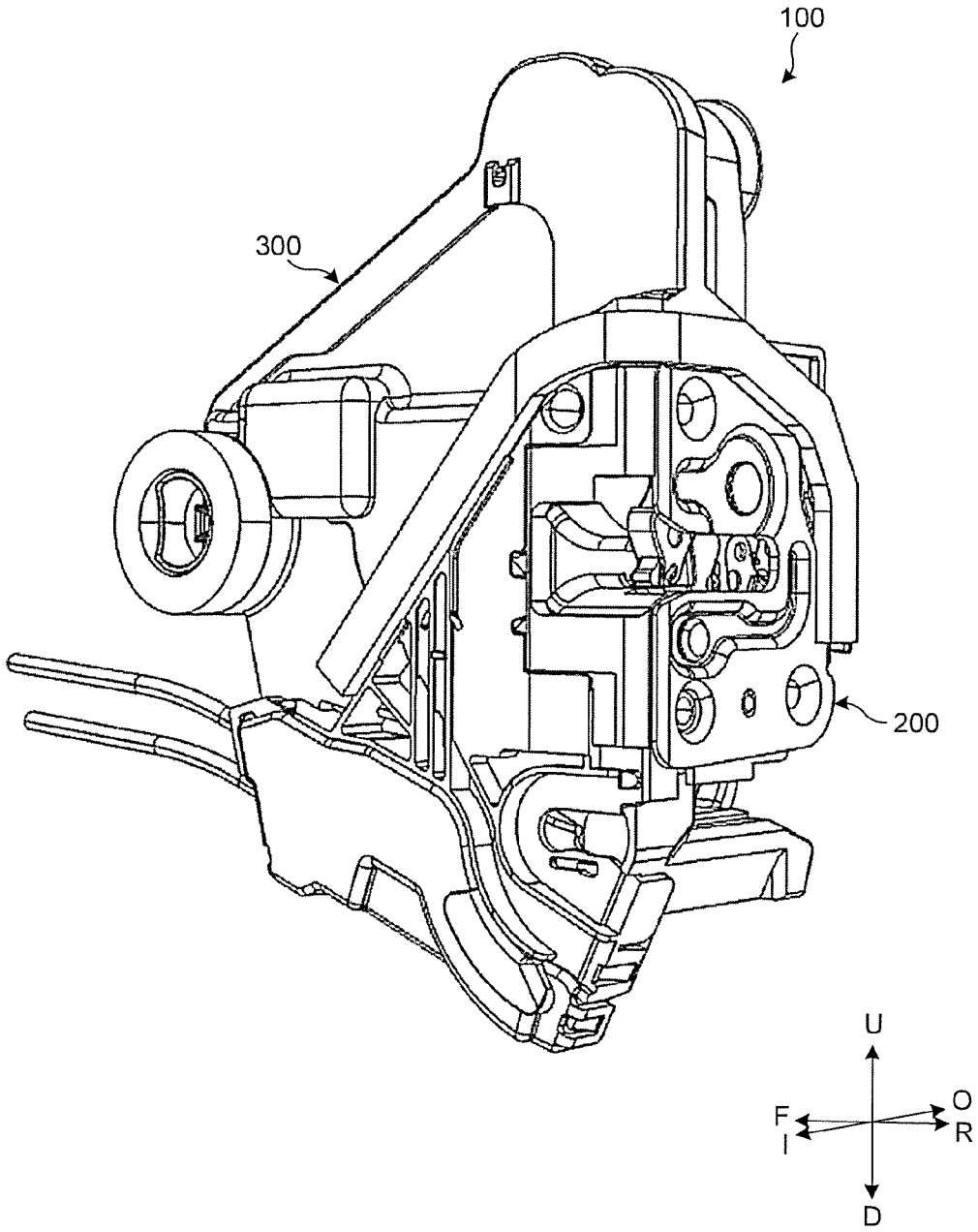
FIG. 1 is a perspective view of a door latch device for a vehicle according to an embodiment of the present invention.

The following describes an embodiment of a door latch device for a vehicle and a method of assembling the door latch device for a vehicle according to the present invention with reference to the drawings. The invention is not limited to the embodiment. The same or corresponding components are appropriately denoted by the same reference numerals throughout the drawings.

Embodiment

The following describes a door latch device for a vehicle according to the embodiment with reference to FIGS. 1 to 13. FIG. 1 is a perspective view of the door latch device for a vehicle according to the embodiment of the present invention. In the following description, in a state in which a door latch device 100 is attached to a vehicle, the left side in FIG. 1 is assumed to be a "vehicle interior side (I)", the right side is assumed to be a "vehicle exterior side (O)", an upper side is assumed to be an "upper side (U)", a lower side is assumed to be a "lower side (D)", the far side of FIG. 1 is assumed to be a "front side (F)", and the near side of FIG. 1 is assumed to be a "rear side (R)". These directions are defined for convenience of explanation, and the orientation of the door latch device 100 is naturally changed depending on a type of a vehicle to which the door latch device 100 is attached, an attached position, and the like.

The door latch device 100 according to the embodiment is attached to a rear end of a front side door (hereinafter, abbreviated as a "door") on the right side of an automobile, and is configured by integrating an engaging unit assembly 200 with an operation unit assembly 300 by mounting the engaging unit assembly 200 to the operation unit assembly 300 for operating the engaging unit assembly 200, the engaging unit assembly 200 to be engaged with a striker on a vehicle body side to keep the door in a closed state.

Figure 2:
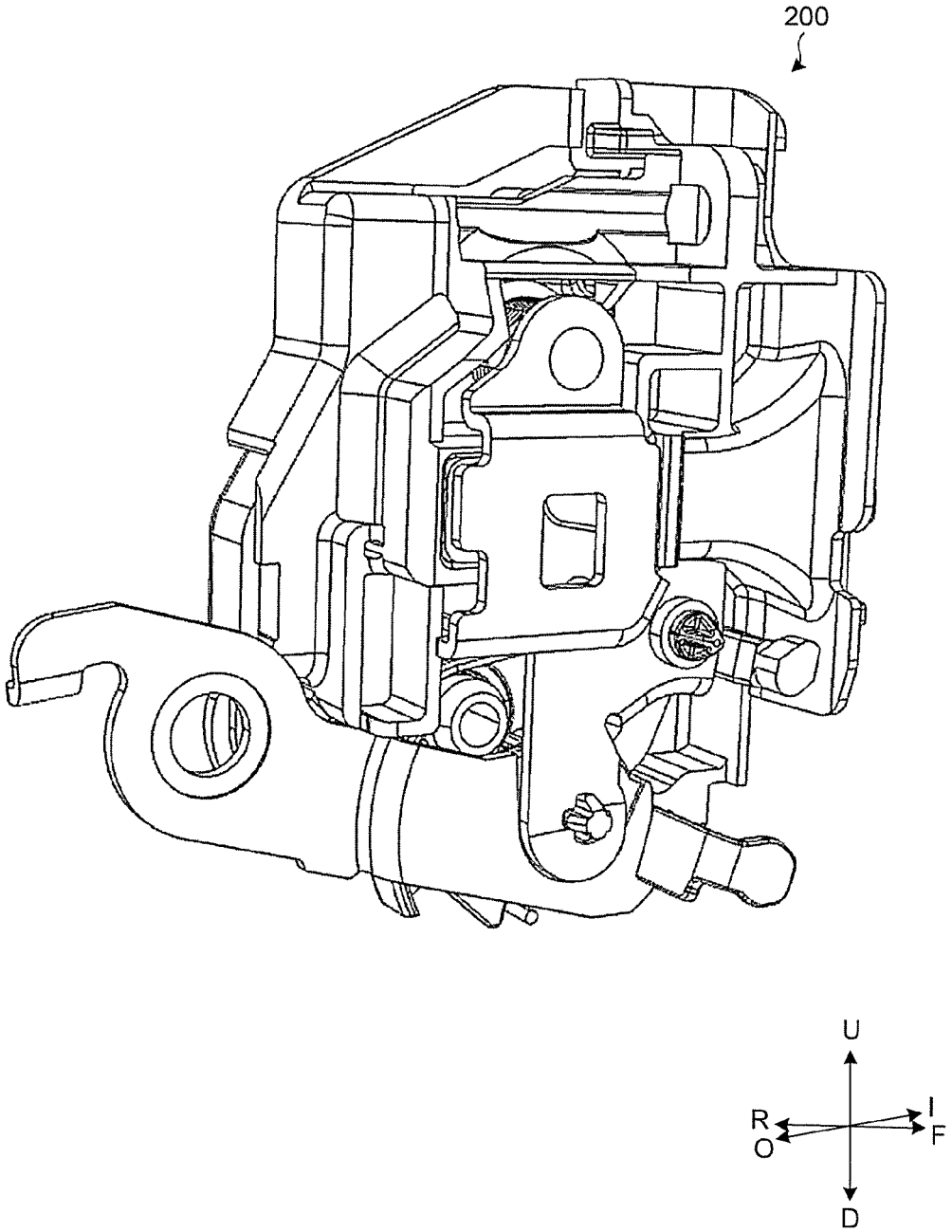
FIG. 2 is a perspective view of an engaging unit assembly of the door latch device for a vehicle illustrated in FIG. 1.
Figure 3:
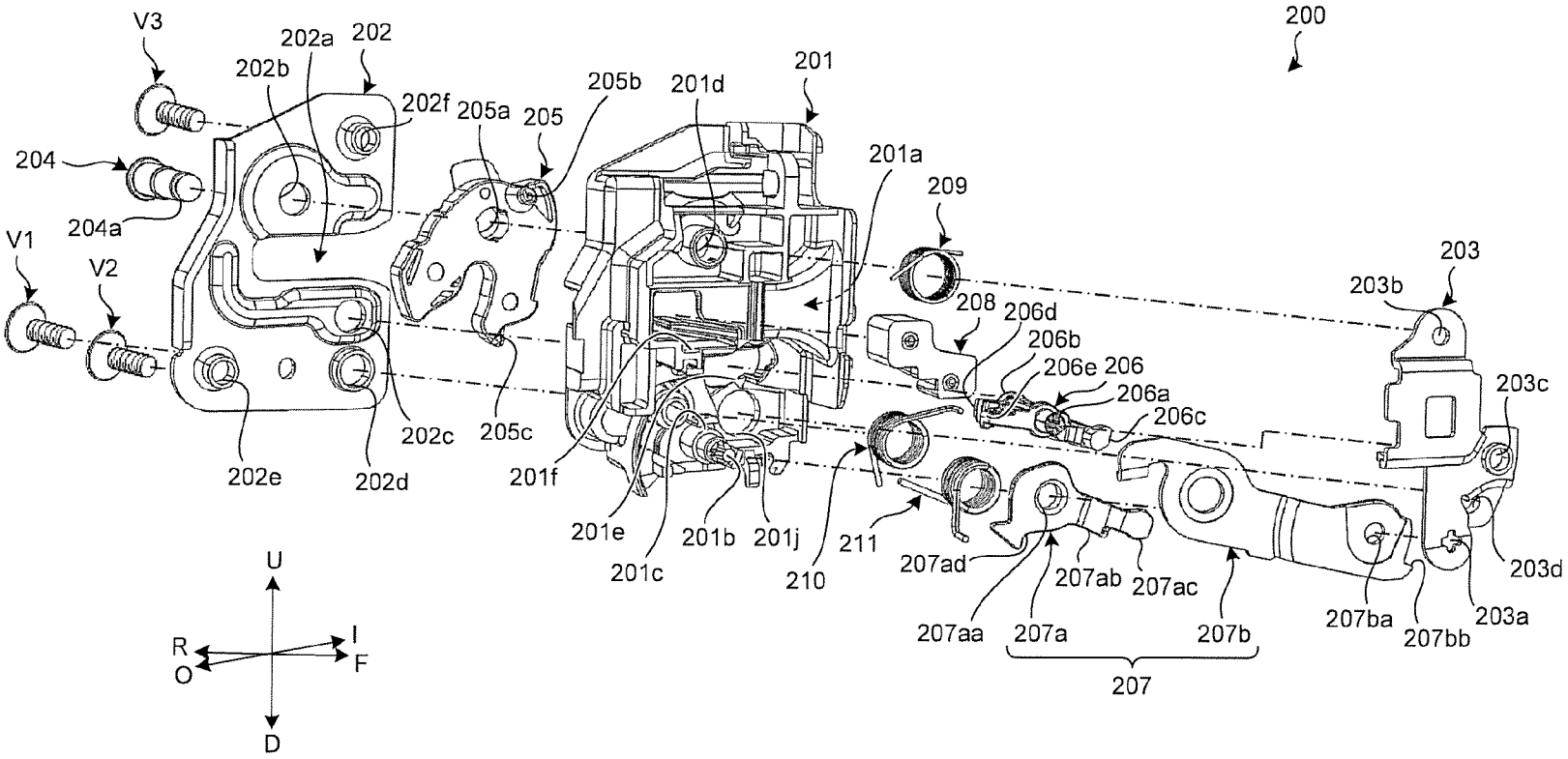
FIG. 3 is an exploded perspective view illustrating a configuration of the engaging unit assembly illustrated in FIG. 2.

First, the following describes a configuration of the engaging unit assembly 200. FIG. 2 is a perspective view of the engaging unit assembly of the door latch device for a vehicle illustrated in FIG. 1. FIG. 3 is an exploded perspective view illustrating the configuration of the engaging unit assembly illustrated in FIG. 2.

As illustrated in FIG. 3, the engaging unit assembly 200 includes a body 201, a cover plate 202 fixed to the rear side of the body 201, a back plate 203 fixed to the front side of the body 201, a latch shaft 204 inserted from the rear side, a latch 205 rotatably supported by the latch shaft 204, a pole 206 engaged with the latch 205 to restrain the door at a closed position, an outside lever 207 serving as a lever that disengages the latch 205 from the pole 206, and a bumper rubber 208 to be in contact with an advanced striker and the pole 206.

Next, the following describes respective members of the engaging unit assembly 200 in detail.

The body 201 is made of synthetic resin, for example. On one side (rear side) of the body 201, formed is a striker advancing groove 201*a* through which the striker provided to the vehicle body advances corresponding to a closing movement of the door.

Figure 4:
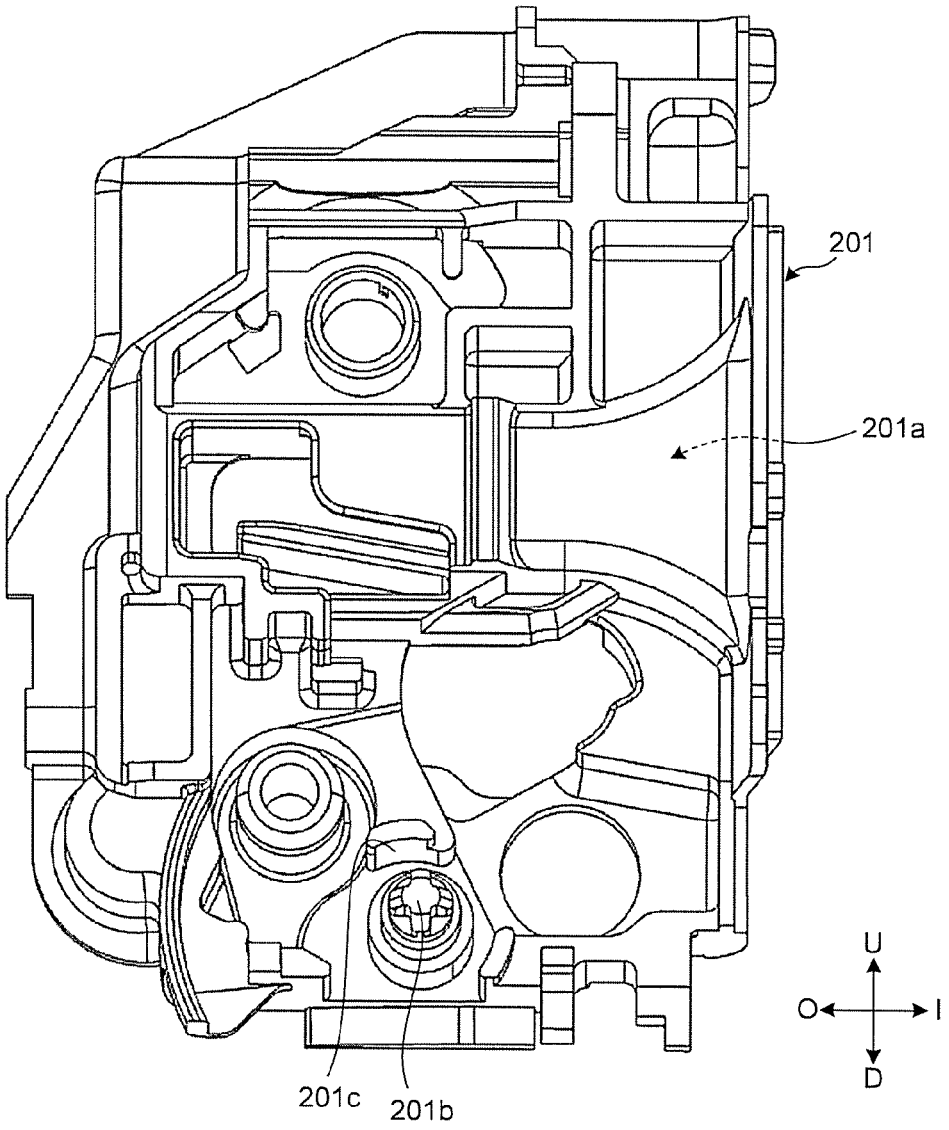
FIG. 4 is a perspective view of a front side of a body of the engaging unit assembly illustrated in FIG. 2 viewed from a lower side.

FIG. 4 is a perspective view of the front side of the body of the engaging unit assembly illustrated in FIG. 2 viewed from the lower side. As illustrated in FIG. 4, the body 201 includes a pivot 201*b* that protrudes toward the front side as the near side of the sheet and has a distal end being a cross-shaped projection. The body 201 also includes a spring accommodating part 201*c* formed around an outer circumference of the pivot 201*b* to enclose the pivot 201*b*.

Returning to FIG. 3, for example, the cover plate 202 is made of various types of metals and includes a cutout part 202*a* through which the striker can advance. The cover plate 202 is mounted on a rear side surface of the body 201 on which the striker advancing groove 201*a* is formed.

The back plate 203 is, for example, made of various types of metals, and is fixed to the cover plate 202 with the body 201 interposed therebetween using the latch shaft 204 and a bolt V1. As a result, the engaging unit assembly 200 is integrated. The back plate 203 also includes a cross-shaped hole 203*a* into which the cross-shaped projection formed at the distal end of the pivot 201*b* of the body 201 is inserted.

The latch shaft 204 passes through a shaft hole 202*b* of the cover plate 202, a shaft hole 205*a* of the latch 205, and a shaft hole 201*d* of the body 201 in this order from the rear side. A small-diameter shaft part 204*a* at the distal end thereof is press-fitted into a shaft hole 203*b* the back plate 203 in a substantially unrotatable manner.

The latch 205 is pivotally supported by the latch shaft 204, accommodated in an inner part on the rear side of the body 201, and engages with the advanced striker so as to rotate about the latch shaft 204 from an open position to the latch position. The latch 205 also includes an engaging part 205*b* protruding toward the front side.

Figure 5:
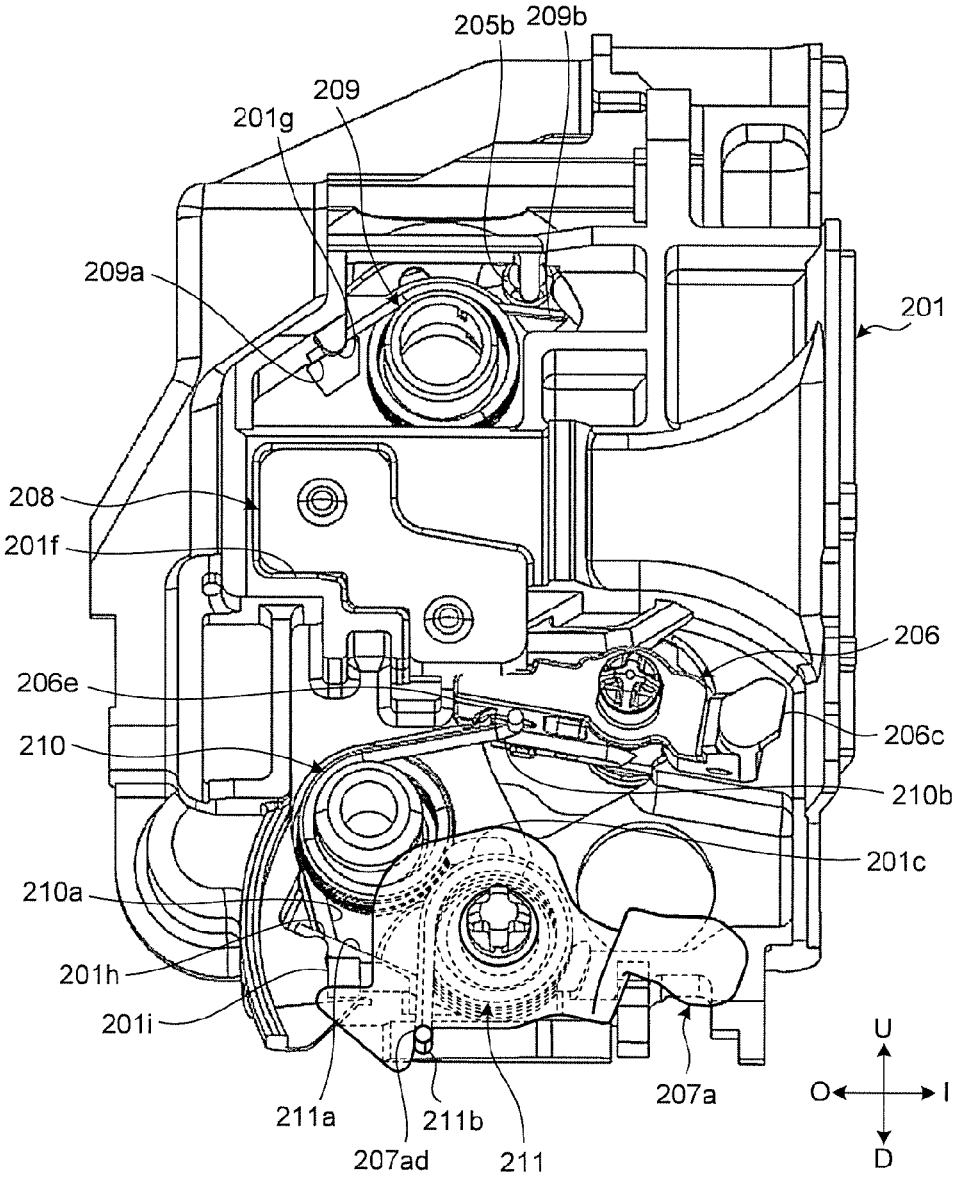
FIG. 5 is a perspective view of the front side of an internal structure of the engaging unit assembly illustrated in FIG. 2 viewed from the lower side.

FIG. 5 is a perspective view of the front side of an internal structure of the engaging unit assembly illustrated in FIG. 2 viewed from the lower side. FIG. 5 illustrates the latch 205 at the latch position. As illustrated in FIG. 5, the latch 205 is urged so that the engaging part 205*b* is engaged with a spring 209 and is rotated from the latch position to the open position (in a counterclockwise direction in FIG. 5).

Returning to FIG. 3, the pole 206 is mounted on a pole mounting hole 201*e* formed on the body 201. A front shaft part 206*a* of the pole 206 is inserted into a shaft hole 203*c* of the back plate 203, and a rear shaft part 206*b* thereof is inserted into a shaft hole 202*c* of the cover plate 202 to be pivotally supported.

Next, FIG. 5 illustrates the pole 206 at an engaging position. The pole 206 is urged by a spring 210 to rotate in a direction toward the engaging position at which the pole 206 is capable of engaging with the latch 205 at the latch position from a release position at which the pole 206 is disengaged from the latch 205. That is, the pole 206 is urged clockwise in FIG. 5.

The pole 206 also includes a release lever 206*c* serving as a lever that disengages the pole 206 from the latch 205 when a release member 302 of the operation unit assembly 300 (described later) is brought into contact with the pole 206 to rotate it from the engaging position to the release position based on an opening operation of a handle provided to the door.

Figure 6:
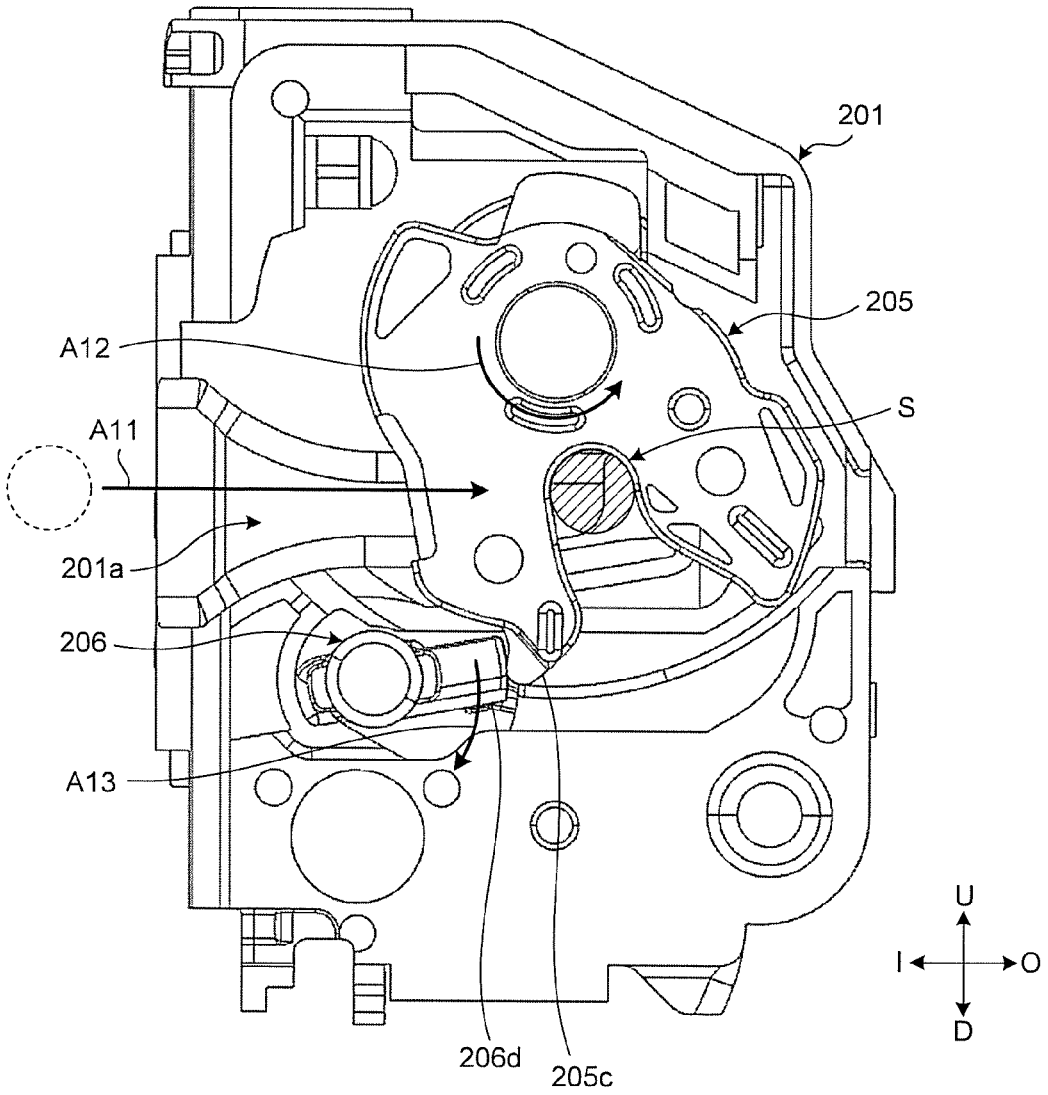
FIG. 6 is a rear view illustrating the internal structure of the engaging unit assembly illustrated in FIG. 2.

FIG. 6 is a rear view illustrating the internal structure of the engaging unit assembly illustrated in FIG. 2. FIG. 6 illustrates the pole 206 at the engaging position. The pole 206 is urged counterclockwise. As a result, the pole 206 rotates from the engaging position to the release position interlocking with the rotation of the latch 205, rotates from the release position to the engaging position due to an urging force, and is engaged with the latch 205, which restrains the door at the closed position. The pole 206 includes an engaging part 206*d* that is capable of engaging with the latch 205 engaging with a striker S.

Returning to FIG. 3, the outside lever 207 has a two-split structure including a first lever 207*a* having a shaft hole 207*aa* through which the pivot 201*b* of the body 201 is inserted, and a second lever 207*b* that is overlapped with the front side of the first lever 207*a* and has a shaft hole 207*ba* through which the pivot 201*b* of the body 201 is inserted. The first lever 207*a* and the second lever 207*b* are rotatably supported by the pivot 201*b* when the pivot 201*b* integrally formed on the body 201 so as to face forward in parallel with the latch shaft 204 is inserted into the cross-shaped hole 203*a* of the back plate 203.

As illustrated in FIG. 5, the first lever 207*a* is urged by a spring 211 to rotate from a disengaging position to a standby position (clockwise in FIG. 5).

Figure 7:
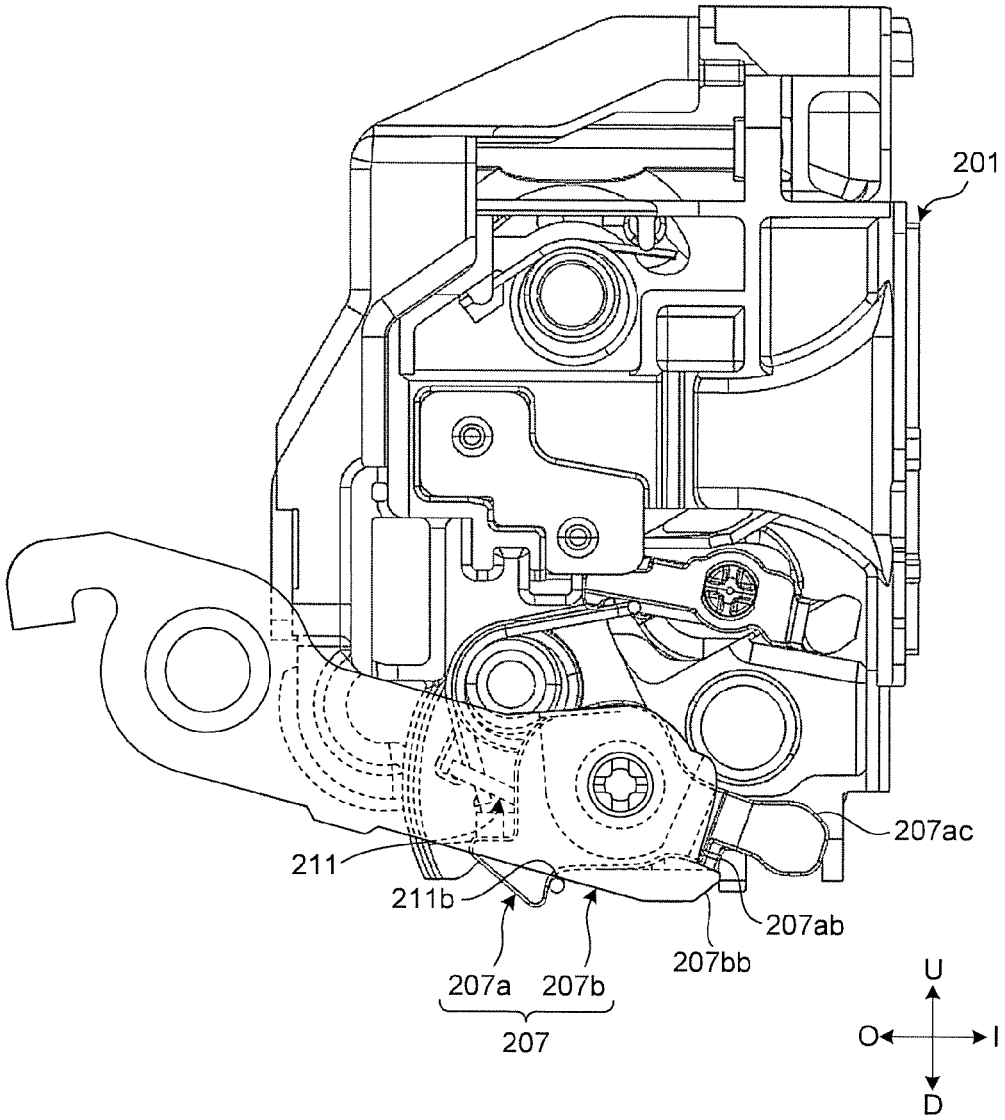
FIG. 7 is a front view illustrating a positional relation between a first lever and a second lever in the engaging unit assembly illustrated in FIG. 2.

FIG. 7 is a front view illustrating a positional relation between the first lever and the second lever in the engaging unit assembly illustrated in FIG. 2. As illustrated in FIG. 7, the second lever 207*b* is urged by the spring 211 to rotate from the disengaging position to the standby position (clockwise in FIG. 7).

The first lever 207*a* and the second lever 207*b* integrally moves from the standby position to the release position illustrated in FIG. 7 (clockwise in FIG. 7) when a claw-like engaging part 207*bb* of the second lever 207*b* protruding toward the vehicle interior side is brought into contact with a lower surface of an engaging part 207*ab* extending in the front and rear direction of the first lever 207*a*.

An end of the second lever 207*b* on the vehicle exterior side is coupled to an outside handle (not illustrated) arranged on an outer panel of the door via an operation force transmitting member (not illustrated) such as a rod. When an opening operation is performed on the outside handle, an input based on the opening operation can be performed on the release lever 206*c* of the pole 206 to open the door via the release member 302 of the operation unit assembly 300 (described later) coupled to an end 207*ac* of the first lever 207*a* on the vehicle interior side.

That is, the outside lever 207 rotates from the disengaging position to the standby position based on the opening operation of the outside handle that is arranged on the door for opening the door from the outside of the vehicle body, and can rotate the interlocking pole 206 from the engaging position to the release position to disengage the latch 205 from the pole 206.

Returning to FIG. 5, the bumper rubber 208 is made of an elastic member such as rubber, and is mounted to a bumper rubber mounting hole 201*f* formed on the body 201 to absorb a shock caused by the advanced striker S.

One end 209*a* of the spring 209 is hooked to a hooked part 201*g* on the front side of the body 201 as the near side of the sheet, and the other end 209*b* thereof is hooked to the engaging part 205*b* of the latch 205 to urge the latch 205.

One end 210*a* of the spring 210 is hooked to a hooked part 201*h* of the body 201, and the other end 210*b* thereof is hooked to an engaging part 206*e* of the pole 206 to urge the pole 206.

The spring 211 is accommodated in the spring accommodating part 201*c*. One end 211*a* of the spring 211 is hooked to the hooked part 201*h* of the body 201, and the other end 211*b* thereof is hooked to an engaging part 207*ad* of the first lever 207*a* to urge the first lever 207*a* and the second lever 207*b*.

Returning to FIG. 3, the volt V1 passes through an attaching hole (not illustrated) of an inner panel of the door, a through hole 202*d* of the cover plate 202, and a through hole 201*j* of the body 201 in this order to be screwed into a screw hole 203*d* of the back plate 203.

A bolt V2 and a bolt V3 pass through attaching holes (not illustrated) of the inner panel of the door to be screwed into a screw hole 202*e* and a screw hole 202*f* of the cover plate 202, respectively. The engaging unit assembly 200 is fixed to the inner panel of the door together with the operation unit assembly 300 using these bolts V1 to V3. In this case, the bolt V1 is also screwed into the screw hole 203*d* of the back plate 203, so that the back plate 203 is fixed to the back surface of the body 201.

Subsequently, the following describes an operation of the engaging unit assembly 200.

First, the following describes the operation of the engaging unit assembly 200 to switch the state of the door from an opened state to a closed state. When a door-closing operation is performed and the striker S advances into the striker advancing groove 201*a* of the body 201 as indicated by the arrow A11 in FIG. 6, the latch 205 rotates from the open position to the latch position illustrated in FIG. 6 as indicated by the arrow A12. The engaging part 206*d* of the pole 206 is brought into contact with the latch 205 and is pressed, and the pole 206 is rotated in the arrow A13 direction. Thereafter the pole 206 is rotated in a direction urged by the spring 210 (counterclockwise in FIG. 6), and an engaging part 205*c* of the latch 205 is engaged with the engaging part 206*d* of the pole 206. The closed state of the door is such a state that the striker S engages with the latch 205, and the engaging part 205*c* of the latch 205 is engaged with the engaging part 206*d* of the pole 206.

Next, the following describes an operation of the engaging unit assembly 200 to switch the state of the door from the closed state to the opened state. When an input based on the opening operation of the handle is performed on the release lever 206*c* of the pole 206 in the closed state of the door, the pole 206 rotates from the engaging position to the release position as indicated by the arrow A13 in FIG. 6, so that the engaging part 205*c* of the latch 205 is disengaged from the engaging part 206*d* of the pole 206. Accordingly, the latch 205 is rotated from the latch position to the open position due to the urging force, and the engaging between the striker S and the latch 205 is released. From this state, when a door-opening operation is further performed in a vehicle outside direction, the door is caused to be in the opened state. When the input based on the opening operation of the handle is canceled, the pole 206 is rotated to return from the release position to the engaging position due to the urging force from the spring 210.

Next, the following describes a configuration of the operation unit assembly 300. The operation unit assembly 300 has a function of causing the door to be openable by disengaging the latch 205 of the engaging unit assembly 200 from the striker through an opening operation of the outside handle on the vehicle exterior side of the door or an inside handle on the vehicle interior side of the door in the unlocked state, and causing the door not to be opened even when the opening operation is performed on the outside handle or the inside handle in the locked state.

Figure 8:
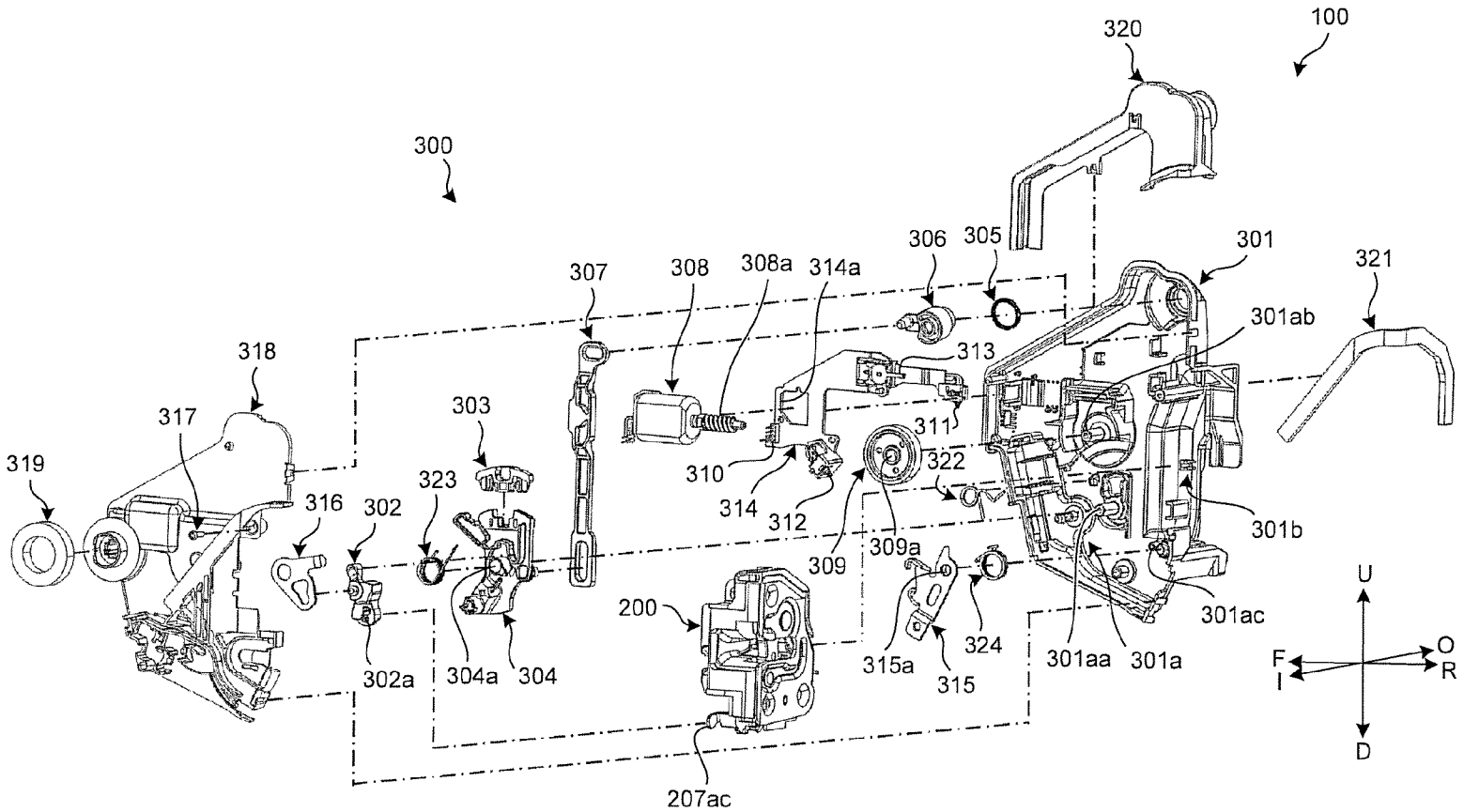
FIG. 8 is an exploded perspective view illustrating a configuration of an operation unit assembly of the door latch device for a vehicle illustrated in FIG. 1.

FIG. 8 is an exploded perspective view illustrating a configuration of the operation unit assembly of the door latch device for a vehicle illustrated in FIG. 1. As illustrated in FIG. 8, the operation unit assembly 300 is incorporated into a substantially L-shaped (in a plan view) casing 301 together with the engaging unit assembly 200.

The operation unit assembly 300 includes: the release member 302 engaged with the first lever 207*a* of the outside lever 207 described above; a lock lever 304 that is engaged with the release member 302, includes a cam silencer 303 fitted thereto, and can switch a locked position and an unlocked position; a slide lever 307 that interlocks with a key access 306 into which a ring 305 is fitted and can switch the position of the lock lever 304 between the locked position and the unlocked position; a motor 308 for a locking operation and an unlocking operation; a worm wheel 309 that engages with the cam silencer 303 and a worm 308*a* fixed to a rotor shaft of the motor 308 and can switch the position of the lock lever 304 between the locked position and the unlocked position; a switch plate 314 that is mounted to the casing 301 by integrally coupling a coupler 310, a half-closed door detection switch 311 that detects the position of the latch 205, a lock/unlock detection switch 312 that detects the position of the lock lever 304, and a key switch 313 that detects the position of the slide lever 307 with each other; an inside lever 315 that causes the door to be openable through the opening operation of the inside handle; and a cancel lever 316 engaged with the release member 302.

The engaging unit assembly 200 and the operation unit assembly 300 are accommodated in a case formed with the casing 301, a covering member 318 made of synthetic resin that covers an opening of the casing 301 on the vehicle interior side and is fixed to the casing 301 using a screw 317, a coupler cushion 319 fitted to the covering member 318 from an vehicle inside direction to protect the outer circumference of the coupler 310, a waterproof cover 320 made of synthetic resin that is fitted from above to prevent rainwater and the like from entering the case, and a waterproof seal 321 attached to a side surface of the covering member 318 on the vehicle interior side to prevent rainwater and the like from entering the vehicle interior side.

Next, the following describes the respective components of the operation unit assembly 300 in detail.

The casing 301 is made of synthetic resin, for example, and includes an operation unit assembly accommodating part 301*a* opened to the vehicle interior side, and a engaging unit assembly accommodating part 301*b* that extends from the rear end of the operation unit assembly accommodating part 301*a* toward the vehicle outside direction at a substantially right angle and is continuous to the operation unit assembly accommodating part 301*a*.

The end 207*ac* on the vehicle interior side of the first lever 207*a* of the outside lever 207 is coupled to a coupling part 302*a* of the release member 302, and the release member 302 interlocks with the outside lever 207. The release member 302 is brought into contact with and interlocks with the inside lever 315 rotated by the opening operation of the inside handle in the unlocked state.

A groove formed at the center of an upper side of the cam silencer 303 is engaged with an engaging part (not illustrated) formed on the vehicle exterior side of the worm wheel 309.

The lock lever 304 is incorporated in the operation unit assembly accommodating part 301*a* such that a shaft tube 304*a* facing a vehicle inside and outside direction is fitted to, from the vehicle interior side, a support shaft 301*aa* facing the vehicle interior side protruding from a side surface of the operation unit assembly accommodating part 301*a*. The lock lever 304 is urged toward the locked position when it is at the locked position, and is urged in the unlocked position when it is at the unlocked position, by a turnover spring 322.

A spring 323 is inserted into the shaft tube 304*a* of the lock lever 304, and the release member 302 is mounted thereon. As a result, the release member 302 is urged by the spring 323 in a direction in which the release member 302 is disengaged from the pole 206 (the lower side in FIG. 8).

The position of the lock lever 304 is switched between the locked position at which the release member 302 is not engaged with the pole 206, and the unlocked position at which the release member 302 is engaged with the pole 206, through an operation of the slide lever 307 or the motor 308.

The key access 306 is rotated by the locking operation and the unlocking operation of a key cylinder (not illustrated) arranged on the outer panel of the door.

The slide lever 307 is mounted into the operation unit assembly accommodating part 301*a* from the vehicle interior side. The slide lever 307 moves in a vertical direction interlocking with the key access 306, and switches the lock lever 304 between the locked position and the unlocked position.

The motor 308 is mounted into an opening 314*a* formed at a substantially center portion of the switch plate 314 from the vehicle interior side. The worm 308*a* fixed to the rotor shaft of the motor 308 engages with the worm wheel 309 so as to rotate forward and backward, and switches the lock lever 304 between the locked position and the unlocked position.

A shaft hole 309*a* at the center of the worm wheel 309 is fitted to a support shaft 301*ab* that faces the vehicle interior side and protrudes from the center portion of the operation unit assembly accommodating part 301*a*. Accordingly, the worm wheel 309 is mounted into the operation unit assembly accommodating part 301*a* from the vehicle interior side. Teeth formed on the outer circumference of the worm wheel 309 engage with the worm 308*a* of the motor 308, and an engaging part thereof formed on the vehicle exterior side engages with the cam silencer 303. As a result, the worm wheel 309 switches the lock lever 304 between the locked position and the unlocked position with the rotation of the motor 308.

The inside lever 315 is mounted into the operation unit assembly accommodating part 301*a* from the vehicle interior side such that a shaft hole 315*a* at an upper end of the inside lever 315 is fitted to a support shaft 301*ac* facing the vehicle interior side that protrudes from a side surface of a rear side end of the operation unit assembly accommodating part 301*a* and is inserted through a spring 324. The inside lever 315 is urged by the spring 324 to be rotated in a direction to return the opening operation of the inside handle to the standby state (counterclockwise in FIG. 8). In the unlocked state, the inside lever 315 can cause the door to be openable through the opening operation of the inside handle.

The cancel lever 316 is engaged with the release member 302. With the cancel lever 316, when a locking operation is performed on a lock knob to be in a locked state with a door opened and the door is closed as it is, the locked state is canceled at the time when the door is closed and switched to the unlocked state, and when a locking operation is performed on the lock knob to be in the locked state with the door opened and the door is closed while performing the opening operation on the outside handle, the locked state is not canceled.

Next, the following describes an operation of the operation unit assembly 300.

Figure 9:
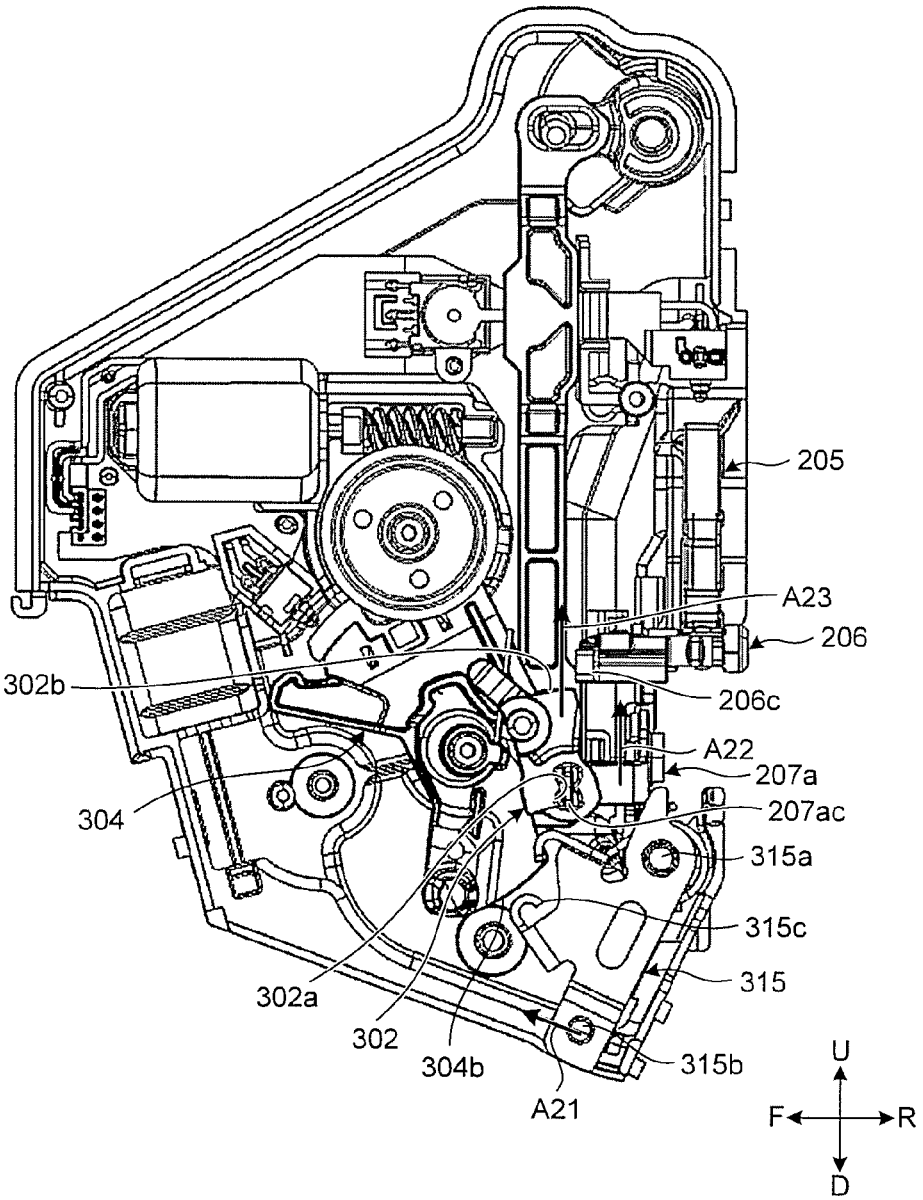
FIG. 9 is a diagram for explaining an operation of an operation unit assembly illustrated in FIG. 8 in a locked state.

First, the following describes a case in which the door is in the locked state, that is, the lock lever 304 is at the locked position. FIG. 9 is a diagram for explaining the operation of the operation unit assembly illustrated in FIG. 8 in the locked state. FIG. 9 is a diagram illustrating the door latch device 100 viewed from the vehicle interior side as the near side of the sheet.

First, as illustrated in FIG. 9, when a door-opening operation is performed on the inside handle, an engaging part 315*b* of the inside lever 315 is pulled in the arrow A21 direction. That is, a force is applied to the inside lever 315 in a direction of rotating about the shaft hole 315*a*. In this case, an engaging part 315*c* of the inside lever 315 is brought into contact with an engaging part 304*b* of the lock lever 304, so that the inside lever 315 does not rotate. Thus the closed state of the door is maintained.

Next, when the door-opening operation is performed on the outside handle, the first lever 207*a* of the outside lever 207 rotates in the arrow A22 direction interlocking with the second lever 207*b* of the outside lever 207. In this case, the end 207*ac* of the first lever 207*a* is coupled to the coupling part 302*a* of the release member 302, so that the release member 302 interlocks with the rotation of the first lever 207*a*. In this case, even when the release member 302 moves upward as indicated by the arrow A23 in the locked state, an engaging part 302*b* of the release member 302 is not brought into contact with the release lever 206*c* of the pole 206 and is idle, so that the closed state of the door is maintained.

As described above, the operation unit assembly 300 operates such that the closed state of the door is maintained even when the opening operation is performed on the inside handle or the outside handle in the locked state.

Figure 10:
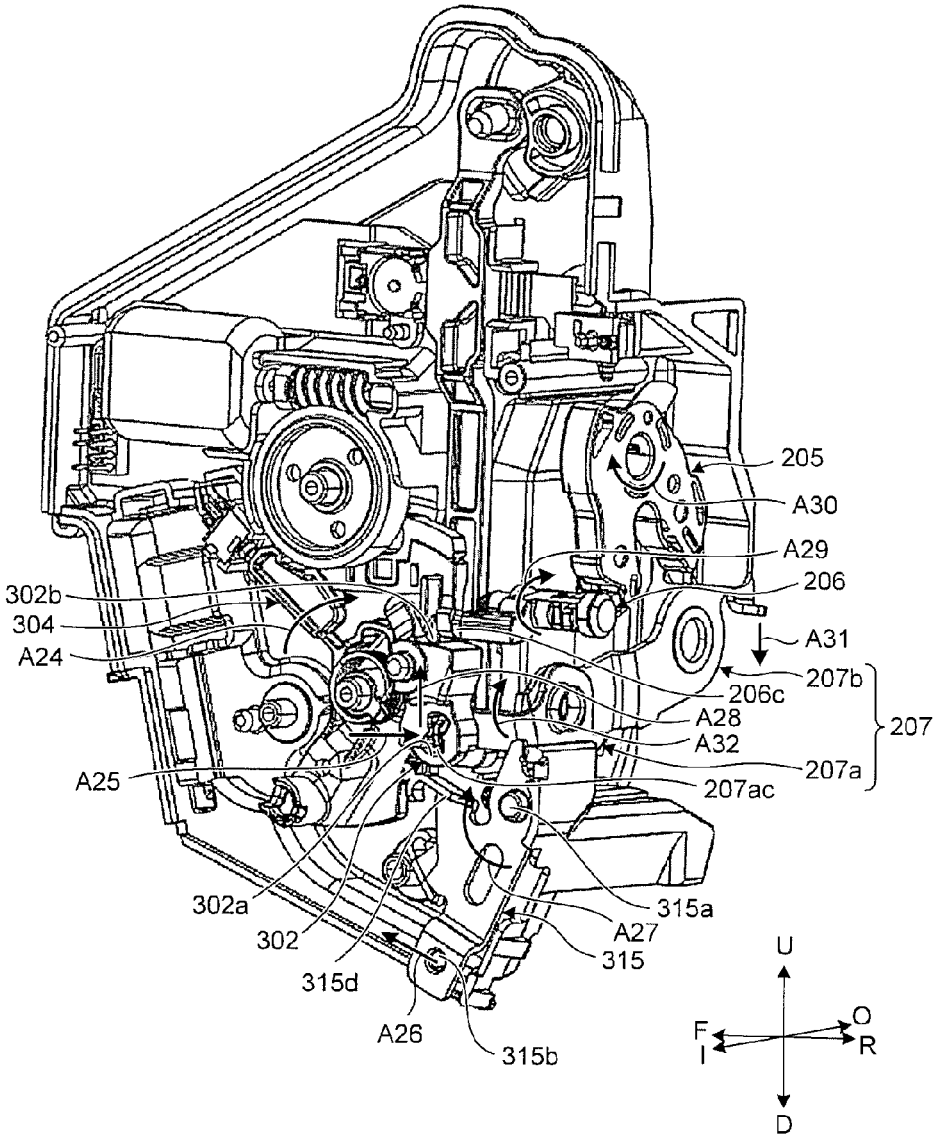
FIG. 10 is a diagram for explaining the operation of the operation unit assembly illustrated in FIG. 8 in an unlocked state.

Next, the following describes a case in which the door is in the unlocked state, that is, the lock lever 304 is at the unlocked position. FIG. 10 is a diagram for explaining the operation of the operation unit assembly illustrated in FIG. 8 in the unlocked state. FIG. 10 is a perspective view of the vehicle interior side of the door latch device 100 viewed from the rear side.

In the unlocked state of the door, the lock lever 304 is at the unlocked position rotated clockwise from the locked position as indicated by the arrow A24. Interlocking therewith, the release member 302 is positioned on the rear side as compared with the locked state as indicated by the arrow A25.

As illustrated in FIG. 10, when the door-opening operation is performed on the inside handle, the engaging part 315*b* of the inside lever 315 is pulled in the arrow A26 direction. Accordingly, the inside lever 315 rotates about the shaft hole 315*a* as indicated by the arrow A27. In this case, an engaging part 315*d* of the inside lever 315 is brought into contact with a lower end of the release member 302, and the release member 302 moves upward as indicated by the arrow A28. In the unlocked state, the engaging part 302*b* of the release member 302 is brought into contact with the release lever 206*c* of the pole 206, so that the pole 206 is rotated as indicated by the arrow A29. As a result, the pole 206 is disengaged from the latch 205, the latch 205 rotates as indicated by the arrow A30, and the engaging between the latch 205 and the striker is released. In this state, when the door-opening operation is performed in the vehicle outside direction, the door is caused to be in the opened state.

Next, when the door-opening operation is performed on the outside handle, the second lever 207*b* of the outside lever 207 is pulled in the arrow A31 direction. The first lever 207*a* of the outside lever 207 then rotates in the arrow A32 direction interlocking with the second lever 207*b*. In this case, the end 207*ac* of the first lever 207*a* is coupled to the coupling part 302*a* of the release member 302, so that the release member 302 moves upward interlocking with the rotation of the first lever 207*a* as indicated by the arrow A28. The engaging part 302*b* of the release member 302 is brought into contact with the release lever 206*c* of the pole 206, so that the pole 206 is rotated as indicated by the arrow A29. As a result, the pole 206 is disengaged from the latch 205, the latch 205 rotates as indicated by the arrow A30, and the engaging between the latch 205 and the striker is released. In this state, when the door-opening operation is performed in the vehicle outside direction, the door is caused to be in the opened state.

As described above, the operation unit assembly 300 operates such that the door is caused to be in the opened state when the opening operation is performed on the inside handle or the outside handle in the unlocked state.

Subsequently, the following describes a process of assembling the engaging unit assembly 200. First, the latch shaft 204 is inserted into the shaft hole 202*b* of the cover plate 202, and the cover plate 202 is set as it is on an automatic assembly line and the like so that the front side of the cover plate 202 faces upward. The latch 205 is overlapped thereon so that the latch shaft 204 is inserted into the shaft hole 205*a*. The body 201 is further overlapped thereon so that the latch shaft 204 is inserted into the shaft hole 201*d*.

Next, the bumper rubber 208 is inserted into the bumper rubber mounting hole 201*f* on the front side of the body 201. The spring 209 is mounted so that the end 209*a* is hooked to the hooked part 201*g* on the front side of the body 201 and the other end 209*b* is hooked to the engaging part 205*b* of the latch 205.

Subsequently, the pole 206 is inserted into the Pole mounting hole 201*e* on the front side of the body 201. The spring 210 is mounted so that the end 210*a* is hooked to the hooked part 201*h* of the body 201 and the other end 210*b* is hooked to the engaging part 206*e* of the pole 206.

Figure 11:
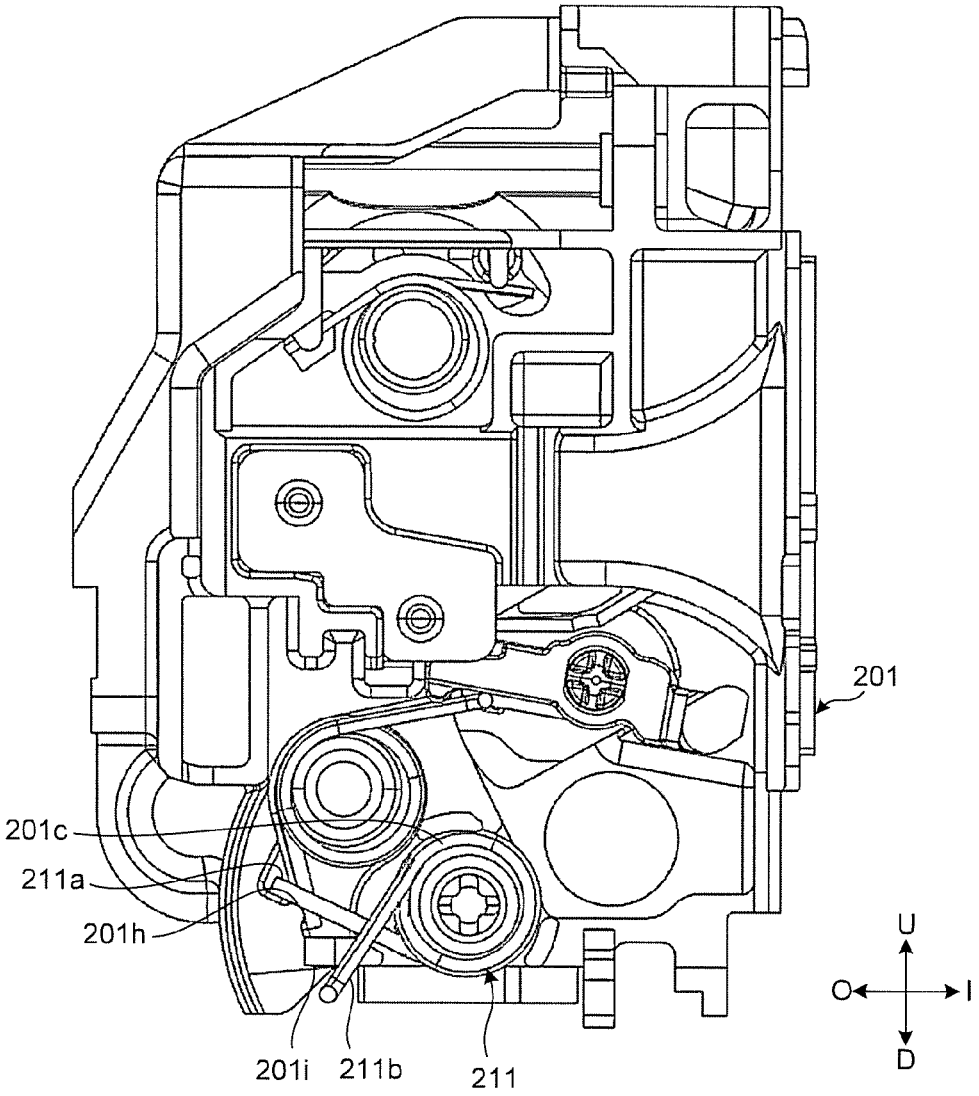
FIG. 11 is a diagram for explaining an assembling process of the engaging unit assembly illustrated in FIG. 2.
Figure 12:
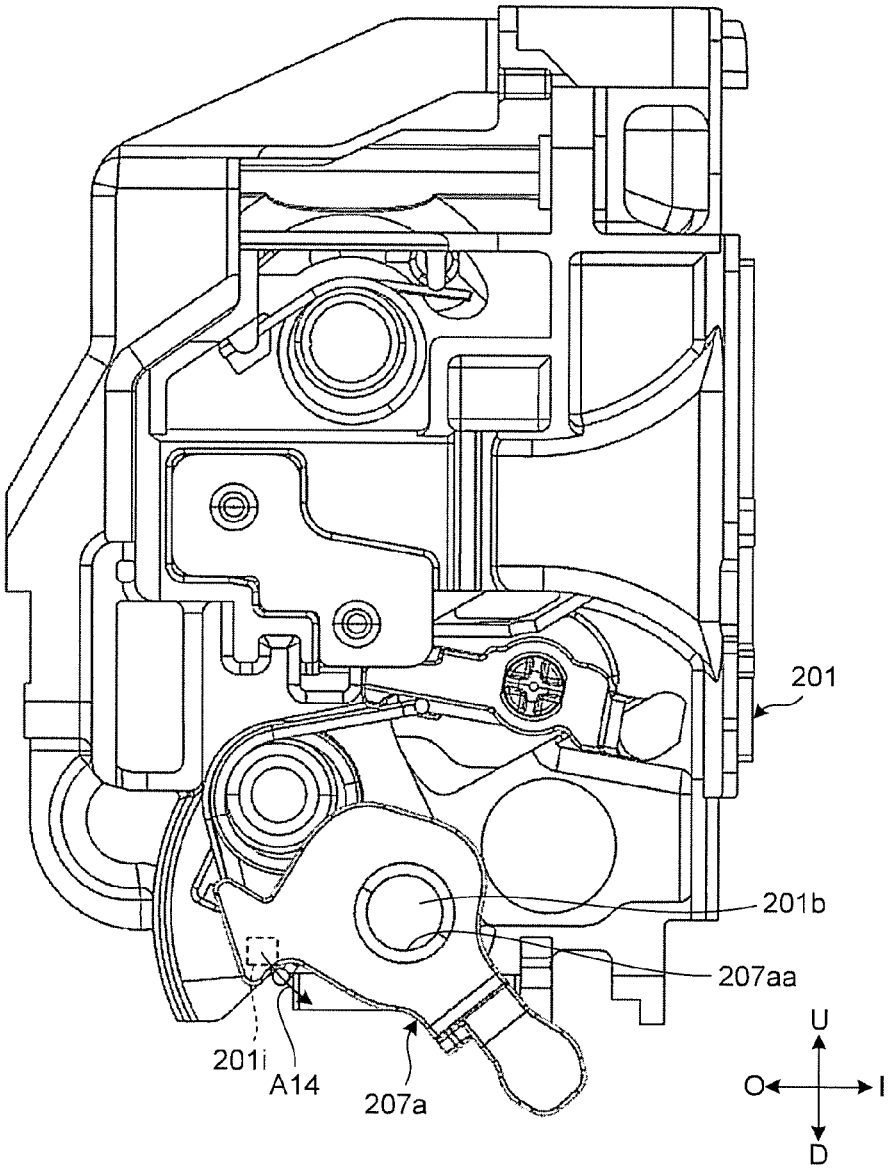
FIG. 12 is a diagram for explaining the assembling process of the engaging unit assembly illustrated in FIG. 2.
Figure 13:
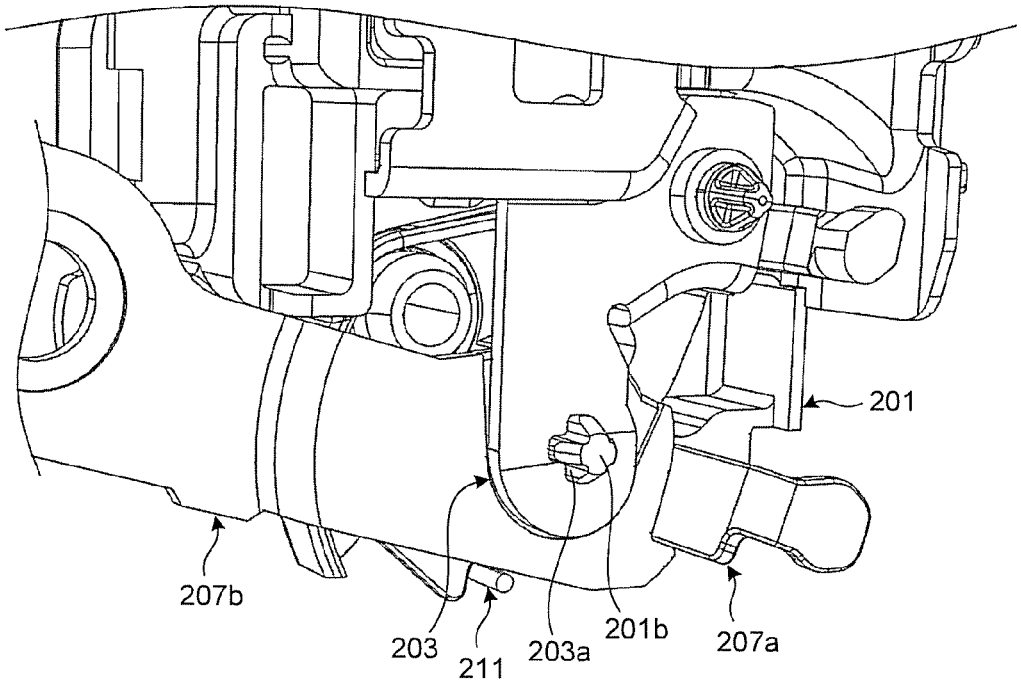
FIG. 13 is a diagram for explaining the assembling process of the engaging unit assembly illustrated in FIG. 2.

FIGS. 11 to 13 are diagrams for explaining the assembling process of the engaging unit assembly illustrated in FIG. 2. As illustrated in FIG. 11, as a mounting process of the spring, the spring 211 is mounted to the spring accommodating part 201*c* of the body 201. In this case, the end 211*a* of the spring 211 is hooked to the hooked part 201*h*, and the end 211*b* of the spring 211 is brought into contact with a projection 201*i* of the body 201.

Next, as illustrated in FIG. 12, as a temporary mounting process of the lever, the pivot 201*b* of the body 201 is inserted into the shaft hole 207*aa* of the first lever 207*a*, and a surface of the first lever 207*a* on the body 201 side is brought into contact with the projection 201*i* of the body 201, which is a temporary mounted state. As a mounting process of the lever, the first lever 207*a* is pressed toward the body 201 to rotate in a direction against the urging force from the spring 211 (in the arrow A14 direction in FIG. 12), and the first lever 207*a* is tightly inserted between the end 211*b* of the spring 211 and the projection 201*i* of the body 201 as illustrated in FIG. 5. The first lever 207*a* that is tightly inserted is brought into contact with the end 211*b* of the spring 211 and the projection 201*i* of the body 201, and is urged by the end 211*b* of the spring 211 to rotate from the disengaging position to the standby position (clockwise in FIG. 12).

The pivot 201*b* of the body 201 is inserted into the shaft hole 207*ba* of the second lever 207*b* so that the second lever 207*b* is overlapped with the front side of the first lever 207*a* as illustrated in FIG. 7.

The small-diameter shaft part 204*a* of the latch shaft 204 is unrotatably press-fitted into the shaft hole 203*b* of the back plate 203. In this case, the screw hole 203*d* of the back plate 203 is caused to be overlapped with the through hole 202*d* of the cover plate 202 and the through hole 201*j* of the body 201. As illustrated in FIG. 13, a cross-shaped projection formed at the distal end of the pivot 201*b* of the body 201 is fitted into the cross-shaped hole 203*a* formed on the back plate 203. Thereafter the bolt V1 is screwed into the screw hole 203*d* of the back plate 203 to assemble the engaging unit assembly 200.

The outside lever in the related art is rotatably fixed to the casing of the operation unit assembly with a screw. That is, a screwing process has been required to mount the outside lever.

However, in the door latch device 100, the outside lever 207 is mounted such that the pivot 201*b* of the body 201 of the engaging unit assembly 200 is inserted through the shaft hole 207*aa* of the first lever 207*a* and the shaft hole 207*ba* of the second lever 207*b*. As a result, the outside lever 207 is integrated with the engaging unit assembly 200, so that another screwing process is not required to mount the outside lever 207. In other words, the door latch device 100 is a door latch device for a vehicle the assembling efficiency of which is improved.

In addition, the door latch device 100 exhibits an effect of reducing the number of components because it eliminates the need for a screw for the screwing process.

The engaging unit assembly 200 is integrally formed by fixing the cover plate 202 to the back plate 203 with the body 201 interposed therebetween using the latch shaft 204 and the bolt V1. The cross-shaped projection of the body 201 is then fitted into the cross-shaped hole 203*a* of the back plate 203 and they are fixed to each other. As a result, the outside lever 207 is rotatably fixed to the engaging unit assembly 200 so as not to be detached. Thus the door latch device 100 is a door latch device for a vehicle the assembling efficiency of which is improved because the screwing process is not required.

Typically, to fix a shaft into a shaft hole, the distal end of the shaft needs to be caulked to be fixed. Examples of a caulking process include rolling caulking. The caulking process requires at least a little less than one second, which is a process taking a longer time than other processes. Due to this, when the number of such caulking processes is large in the assembling process of the door latch device that takes about several seconds as a whole, the assembling efficiency is decreased.

However, the door latch device 100 requires no caulking process in mounting the outside lever 207 due to the configuration described above. Thus the door latch device 100 is a door latch device for a vehicle the assembling efficiency of which is improved.

As described above, the outside lever has been mounted on the operation unit assembly side in the related art, so that a spring for urging the outside lever needs to be arranged between the outside lever and the engaging unit assembly. This arrangement degrades a mounting property of the spring, and the spring may come off in an assembling work. In addition, because the spring is disposed between the outside lever and the engaging unit assembly, the size of the door latch device has been disadvantageously increased.

However, in the door latch device 100, the spring 211 is accommodated in the spring accommodating part 201*c* of the body 201, and the back plate 203 is fixed thereon via the first lever 207*a* and the second lever 207*b*. As a result, the spring 211 is accommodated in a space enclosed by the body 201 and the back plate 203 and is prevented from coming off. Thus, the door latch device 100 is a door latch device for a vehicle the mounting property of which is improved.

The spring 211 is accommodated in a space enclosed by the body 201 and the back plate 203, so that a space for disposing the spring 211 is not required between the outside lever 207 and the engaging unit assembly 200. Thus, the door latch device 100 is a downsized door latch device for a vehicle.

Typically, a process of tightly inserting another member between two members requires a complicated process of applying a force to at least the two members at the same time. However, the assembling process of the door latch device 100 includes the mounting process of the spring, the temporary mounting process of the lever, and the mounting process of the lever, which are processes of applying a force to one of the spring 211 and the first lever 207*a*. As a result, the door latch device 100 is a door latch device for a vehicle that requires no complicated process and has an improved mounting property.

As described above, the door latch device 100 according to the embodiment is a door latch device for a vehicle the assembling efficiency of which is improved, and a method of assembling the door latch device 100 is a method of assembling the door latch device for a vehicle the assembling efficiency of which is improved.

In the above embodiment, the door latch device for a vehicle is arranged on the door side, and the striker is arranged on the vehicle body side. However, the door latch device for a vehicle is not limited thereto. That is, the door latch device for a vehicle can be applied in a case in which the door latch device for a vehicle is provided on the vehicle body side and the striker is provided on the door side.

In the above embodiment, the door latch device for a vehicle is attached to the front side door of the automobile. Naturally, the door latch device for a vehicle according can also be attached to a rear door.

In the above embodiment, the door latch device for a vehicle is attached to the right door of the automobile. When the door latch device for a vehicle is attached to the left door of the automobile, the configuration may be bilaterally symmetrical to the above configuration with respect to a plane along a front and rear direction of the vehicle.

In the above embodiment, the distal end of the pivot of the body is the cross-shaped projection, which is fitted into the cross-shaped hole of the back plate. However, the door latch device for a vehicle is not limited thereto. That is, it is sufficient that the shape of the distal end of the pivot of the body is identical to the shape of the shaft hole of the back plate, and the distal end is fitted into the shaft hole to allow the positions of the body and the back plate to be fixed each other. For example, the shape thereof may be a polygon.

The door latch device for a vehicle is a door latch device for a vehicle the assembling efficiency of which is improved, and the method of assembling a door latch device for a vehicle is a method of assembling the door latch device for a vehicle the assembling efficiency of which is improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door latch device for a vehicle comprising:

a body that is arranged on any one of a door or a vehicle body and has a striker advancing groove formed on one surface thereof through which a striker advances corresponding to a closing movement of the door, the striker being arranged on the other one of the door and the vehicle body;

a latch configured to engage with the advanced striker so as to be rotatable from an open position to a latch position;

a pole configured to rotate from a release position at which the pole is disengaged from the latch to an engaging position at which the pole is capable of engaging with the latch at the latch position interlocking with rotation of the latch and be engaged with the latch so as to restrain the door at a closed position;

a lever configured to rotate from a disengaging position to a standby position based on an opening operation of a handle to rotate the interlocking pole from the release position to the engaging position, the handle being arranged on the door or the vehicle body;

a spring configured to urge the lever to rotate from the disengaging position to the standby position;

a cover plate mounted on a surface of the body on which the striker advancing groove is formed; and a back plate fixed to the cover plate with the body interposed therebetween, wherein the lever has a shaft hole, the body comprises:

a spring accommodating part that accommodates the spring; and a pivot that is inserted into the shaft hole of the lever to rotatably support the lever, a distal end of the pivot of the body is a projection, and the back plate has a hole into which the projection is inserted.

2. The door latch device for a vehicle according to claim 1, wherein the lever is an outside lever configured to rotate from the disengaging position to the standby position based on an opening operation of an outside handle arranged on the door for opening the door from the outside of the vehicle body.

3. The door latch device for a vehicle according to claim 1, wherein the projection is a cross-shaped projection, and the hole is a cross-shaped hole into which the cross-shaped projection is inserted.

4. The door latch device for a vehicle according to claim 1, wherein the lever has a two-split structure including a first lever that has a shaft hole to which the pivot of the body is inserted, and a second lever that has a shaft hole to which the pivot of the body is inserted, and overlaps with the first lever.

5. The door latch device for a vehicle according to claim 1, wherein the body comprises:

a hooked part to which one end of the spring is hooked; and a projection that is brought into contact with the lever at the standby position, the spring is mounted in a state in which one end thereof is hooked to the hooked part of the body, and the other end thereof is brought into contact with the projection of the body, the lever is caused to be in a temporary mounted state in which the pivot of the body is inserted into the shaft hole of the lever, and a surface of the lever on the body side is brought into contact with the projection of the body, and the lever is pressed toward the body side to be rotated in a direction against an urging force from the spring, and the lever is tightly inserted between the other end of the spring and the projection of the body to be mounted.

6. A method of assembling a door latch device for a vehicle, the door latch device for a vehicle comprising:

a body that is arranged on any one of a door or a vehicle body and has a striker advancing groove formed on one surface thereof through which a striker advances corresponding to a closing movement of the door, the striker being arranged on the other one of the door and the vehicle body;

a latch configured to engage with the advanced striker to be rotatable from an open position to a latch position;

a pole configured to rotate from a release position at which the pole is disengaged from the latch to an engaging position at which the pole is capable of engaging with the latch at the latch position interlocking with rotation of the latch and be engaged with the latch so as to restrain the door at a closed position;

a lever configured to rotate from a disengaging position to a standby position based on an opening operation of a handle to rotate the interlocking pole from the release position to the engaging position, the handle being arranged on the door or the vehicle body;

a spring configured to urge the lever to rotate from the disengaging position to the standby position;

a cover plate mounted on a surface of the body on which the striker advancing groove is formed; and a back plate fixed to the cover plate with the body interposed therebetween, wherein the lever has a shaft hole, the body comprises:

a spring accommodating part that accommodates the spring;

a pivot that is inserted into the shaft hole of the lever to rotatably support the lever;

a hooked part to which one end of the spring is hooked; and a projection that is brought into contact with the lever at the standby position;

a distal end of the pivot of the body is a projection, and the back plate has a hole into which the projection is inserted, the method comprising:

a mounting process of the spring for causing one end of the spring to be hooked to the hooked part, and causing the other end of the spring to be brought into contact with the projection of the body;

a temporary mounting process of the lever for inserting the pivot of the body into the shaft hole of the lever, and causing a surface of the lever on the body side to be brought into contact with the projection of the body; and a mounting process of the lever for pressing the lever toward the body side to rotate in a direction against an urging force from the spring, and tightly inserting the lever between the other end of the spring and the projection of the body.

7. A door latch device for a vehicle manufactured by using the method of assembling the door latch device for a vehicle according to claim 6.

* * * * *